US007918107B2

(12) United States Patent
Klotten et al.

(10) Patent No.: US 7,918,107 B2
(45) Date of Patent: Apr. 5, 2011

(54) INTERNAL HEAT EXCHANGER

(75) Inventors: Thomas Klotten, Köln (DE); Roman Heckt, Aachen (DE); Stephan Köster, Langerwehe (DE)

(73) Assignee: Visteon Global Technologies, Inc., Van Buren Township, MI (US)

( * ) Notice: Subject to any disclaimer, the term of this patent is extended or adjusted under 35 U.S.C. 154(b) by 370 days.

(21) Appl. No.: 11/770,326

(22) Filed: Jun. 28, 2007

(65) Prior Publication Data

US 2008/0000261 A1 Jan. 3, 2008

(30) Foreign Application Priority Data

Jul. 3, 2006 (DE) ..... 10 2006 031 197

(51) Int. Cl.
*F25B 43/00* (2006.01)
*F25B 41/00* (2006.01)
*F25B 39/02* (2006.01)

(52) U.S. Cl. ..... 62/503; 62/513; 62/515

(58) Field of Classification Search ..... 62/503, 62/513, 515
See application file for complete search history.

(56) References Cited

U.S. PATENT DOCUMENTS

| | | | | |
|---|---|---|---|---|
| 5,222,378 | A * | 6/1993 | Chuan | 62/474 |
| 5,396,776 | A * | 3/1995 | Kim | 62/115 |
| 5,507,159 | A | 4/1996 | Cooksey | |
| 5,778,696 | A | 7/1998 | Conner | |
| 6,076,597 | A | 6/2000 | Manning et al. | |
| 6,102,106 | A | 8/2000 | Manning et al. | |
| 6,463,757 | B1 * | 10/2002 | Dickson et al. | 62/503 |
| 6,612,128 | B2 | 9/2003 | Dickson et al. | |
| 2001/0015078 | A1 * | 8/2001 | Schroeder et al. | 62/503 |
| 2002/0095948 | A1 | 7/2002 | Corrigan et al. | |
| 2003/0056532 | A1 | 3/2003 | Dickson et al. | |
| 2003/0079496 | A1 | 5/2003 | Schroeder et al. | |
| 2005/0081559 | A1 | 4/2005 | McGregor et al. | |
| 2006/0236716 | A1 | 10/2006 | Griffin et al. | |

FOREIGN PATENT DOCUMENTS

| | | | |
|---|---|---|---|
| DE | 31 19 440 | A1 | 12/1982 |
| DE | 3127317 | A1 | 1/1983 |
| DE | 3543230 | A1 | 6/1986 |
| DE | 195 46 489 | A1 | 1/1997 |
| DE | 199 03 833 | A1 | 8/2000 |
| DE | 102 61 886 | A1 | 7/2003 |
| DE | 10 2004 032 288 | B3 | 9/2005 |
| DE | 10 2004 050 049 | A1 | 4/2006 |
| EP | 1 255 954 | B1 | 9/2005 |
| GB | 2 386 939 | A | 10/2003 |
| GB | 2 386 940 | A | 10/2003 |
| JP | 2000329430 | A | 11/2000 |
| WO | WO 99/34162 | | 7/1999 |
| WO | WO 01/55652 | A1 | 8/2001 |

* cited by examiner

*Primary Examiner* — Thomas E Denion
*Assistant Examiner* — Michael Carton
(74) *Attorney, Agent, or Firm* — Fraser Clemens Martin & Miller LLC; J. Douglas Miller

(57) ABSTRACT

An internal heat exchanger including an integrated accumulator is disclosed, wherein the heat exchanger is used in refrigerant circuits, particularly in motor vehicle heating, ventilation, and air conditioning systems.

14 Claims, 3 Drawing Sheets

INTERNAL HEAT EXCHANGER

CROSS-REFERENCE TO RELATED APPLICATION

This application claims the benefit of German Patent Application No. 102006031197.3 INTERNAL HEAT EXCHANGER filed on Jul. 3, 2006, hereby incorporated herein by reference in its entirety.

FIELD OF THE INVENTION

The invention relates to an internal heat exchanger including an integrated accumulator for use in refrigerant circuits, particularly in motor vehicle heating, ventilation, and air conditioning systems (HVACs).

BACKGROUND OF THE INVENTION

In a refrigerant machine or heat pump, an accumulator is arranged downstream of an evaporator to catch different refrigerant volumes due to different operational conditions, and to keep a refrigerant reserve stock for balancing leakage losses during maintenance intervals. An internal heat exchanger functions to transfer heat within the system for supercooling from a warm high-pressure side to a cold low-pressure side (suction side), which in its turn is thereby heated, or overheated, respectively.

From DE 31 19 440 A1, hereby incorporated by reference herein in its entirety, a plant heat exchanger for refrigeration plants is known, the heat exchanger having an internal container arranged within an external container, whereby in the space between both containers there is a tube coil for the refrigerant flowing from the condenser to the evaporator. The exit line of the evaporator leads into the space, which through an overflow tube is connected to the internal container, from which suction into the compressor takes place. This embodiment regularly presents the problem that the can-like external container must expensively be equipped with the connections required for the various refrigerant lines.

For these connections, the inner tube ends have to be connected to the covers of the case, preferably from the interior. Current solutions known in the art are characterized by that the cylindrical ends of the tube coils are led through the external case and sealed to the exterior by welding, brazing, soldering or using screw connections, for example. Further connection of the components is always through a second screw connection at the same tube ends led through from the interior of the heat exchanger.

Such a solution is disadvantageous in that the connection points, which protrude far from the component, are highly susceptible to damage. Another disadvantage is that the tubes, when led through the cover or bottom of the container, are connected by metallurgical joining such as welding, brazing or soldering, which require much effort, are expensive, and are not very reliable. Additionally the heat input during metallurgical joining can adversely affect the mechanical properties of the materials. Accordingly, mechanical dimensioning must be based on thicker walls, or higher-grade materials must be used, processing of which is, in addition, more expensive. Further, cost-effective design cannot be realized when metallurgically joining from the exterior of the heat exchanger.

From DE 199 03 833 A1, hereby incorporated by reference herein in its entirety, an integrated collector-heat exchanger unit is shown which again consists of an intricately shaped container having refrigerant connections with accordingly sophisticated design. It is a particular disadvantage of the solutions to the state-of-the-art that the cases cannot be manufactured as efficiently as desired because the intricate geometries require steps of material processing and connection technologies which are complicated and expensive as well as susceptible to leakage.

Accordingly, it would be desirable to produce a combined internal heat exchanger and accumulator, wherein a cost of manufacture thereof and a space required thereby are minimized and an efficiency thereof is maximized.

SUMMARY OF THE INVENTION

Harmonious with the present invention, a combined internal heat exchanger and accumulator, wherein a cost of manufacture thereof and a space required thereby are minimized and an efficiency thereof is maximized, has surprisingly been discovered.

In one embodiment, an internal heat exchanger comprises a main body including a tubular outer cylinder, a cover plate, and a bottom plate; an accumulator substantially concentrically disposed in the main body for transmitting a liquid refrigerant at low pressure; and a finned tube for transmitting the refrigerant at high pressure, wherein the finned tube is disposed in a gap formed between the accumulator and the outer cylinder.

In another embodiment, an internal heat exchanger comprises a main boy including a tubular outer cylinder, a cover plate, and a bottom plate, wherein the outer cylinder, the cover plate and the bottom plate are formed from aluminium; an accumulator formed from a minimized heat conducting material and substantially concentrically disposed in the main body for transmitting a liquid refrigerant at low pressure, the accumulator including a suction tube having a vapor entrance and a vapor exit; and a coiled finned tube for transmitting the refrigerant at high pressure, wherein the finned tube is disposed in a gap formed between the accumulator and the outer cylinder, and wherein a first end of the finned tube is sealed to the cover plate and a second end of the finned tube is sealed to the bottom plate.

In another embodiment, an internal heat exchanger comprises a main body including a tubular outer cylinder, a cover plate, and a bottom plate, wherein the outer cylinder; an accumulator formed from a minimized heat conducting material and substantially concentrically disposed in the case for transmitting a liquid refrigerant at low pressure, the accumulator including a suction tube having a vapor entrance and a vapor exit, a deflecting device for separating liquid and vapor phases of the refrigerant, the vapor entrance disposed below the deflecting device and the vapor exit disposed outside of the accumulator, wherein the suction tube includes a first portion and a second portion, the first portion including the vapor exit and the second portion including the vapor entrance, an oil suction hole, and an oil filter, wherein the vapor entrance is disposed concentrically with a central axis of the heat exchanger and a bottom portion of the second portion is disposed at a lower region of the accumulator, and wherein the vapor entrance of the suction tube includes a gas filter, the deflecting device including a means for collecting the liquid refrigerant and a means for transmitting the refrigerant into the lower region of the accumulator; and a finned tube for transmitting the refrigerant at high pressure, wherein the finned tube is disposed in a gap formed between the accumulator and the outer cylinder, and wherein a first end of the finned tube is sealed to the cover plate and a second end of the finned tube is sealed to the bottom plate.

The problems with single component systems discussed above are solved by an internal heat exchanger with an accumulator for refrigerant circuits, particularly in motor vehicle HVACs, the internal heat exchanger including a case designed of a pressure-carrying tubular outer cylinder and a cover plate as well as a bottom plate, an accumulator for the liquid refrigerant at low pressure disposed in the case, concentrically establishing a gap, the accumulator formed from a minimized heat-conducting material, and a coiled finned tube for the refrigerant at high pressure disposed in the gap between the accumulator and the outer cylinder.

The combined internal heat exchanger and accumulator integrates the functionalities of both individual components in a single component. The combined component can be used in mobile R744-refrigeration plants, and in refrigerant circuits for vehicle air conditioning, for example. Compared with the individual components, the combined and thus compact component "AccuIHX" adapts better to the limited space in the engine compartment and additionally, has a favorable effect on the costs of the mobile refrigeration plant as an entire system.

Combining the accumulator and the internal heat exchanger can be established by coaxially disposing two containers arranged concentrically. The inner container functions as the accumulator. In an annular gap formed between the inner and outer containers, for example, the internal heat exchanger is disposed. In most cases, the internal heat exchanger is made of a heat exchanger tube wound up to a tube coil which is coaxially arranged in the gap between the inner container and the outer container. Such tube coils can be established as smooth tubes, finned tubes or bundles of tubes, for example.

The concept of connecting two components such as the accumulator and the internal heat exchanger is particularly advantageous, because just for high-pressure applications the component stability must expensively be ensured by means of additional material or specific design measures. Integrating the accumulator into the pressure-carrying case formed of a tubular outer cylinder results in that substantially no pressure resistance of the accumulator case is needed, which brings appreciable material savings. This leads to reduced weight and costs, which is considerably advantageous for mobile applications of the component. The consequent realisation of this concept results in that the accumulator case can be designed as a thin-walled plastic component.

Materials such as plastics, ceramics, but also coated metals or multi-layer composite materials are used as minimized heat conductors for the accumulator encasement. The heat input from the internal heat exchanger to the accumulator is thus minimized. This is essential in order to not adversely affect the accumulator function by the concentrically arranged warmer internal heat exchanger. Heat input would lead to evaporation of the refrigerant which is stored in liquid form, thus adversely affecting the coefficient of performance of the entire refrigeration plant.

The cover and bottom plates of the combined component each are provided with a connection plate equipped with connections for the refrigerant lines. In the accumulator, a U-shaped suction tube with a vapor entrance and a vapor exit for the refrigerant vapor and in the upper region of the accumulator, a deflecting device for separating the liquid and vapor phases of the refrigerant are provided.

The vapor entrance of the suction tube is protected from the liquid refrigerant, as the liquid refrigerant is placed below the deflecting device in the accumulator, whereas the vapor exit is arranged outside the accumulator.

The finned tube, preferably finned only in the region of the coils, is integrated at its ends into the cover plate and the bottom plate in a sealing manner, preferably via threads.

The concept of the invention consists in that the basic elements of the combined component are designed to consist of components which can be manufactured easily.

Particularly, the case of the internal heat exchanger with accumulator is designed to consist of a tubular outer cylinder and uniform cover and bottom plates. So the intricately designed container bottoms of comparable components according to prior art are not needed. Particularly preferred is the substantially identical design of the cover and bottom plates, which leads to manufacture and cost benefits due to standardization.

It is conducive to advantageous manufacture of the component according to this invention that the finned tube of the internal heat exchanger can be connected to the cover and bottom plates by use of threaded joints. Thus, undesirable effects when manufacturing the metallurgical connection of the finned tube, such as by welding, brazing or soldering, are avoided in this embodiment. The sealing requirements of the threaded joints are comparatively low as any leakage occurs only internally, between the finned tube and the interior of the component, and only during operation of the refrigerant circuit. The connections to the exterior, which set greater sealing requirements, are located at the connection plates of the cover and bottom plates and can be made using any connection technology admitted in automobile refrigeration applications. Further, it is advantageous that the accumulator can be made of a plastic material, which is substantially conducive to weight reduction and accompanying advantages when using the combined component in mobile refrigeration plants.

According to an embodiment of the invention, the low-pressure entrance, the low-pressure exit and the vapor entrance can be arranged concentrically on the central axis of the internal heat exchanger with accumulator.

The outer cylinder, the cover plate and the bottom plate are preferably formed from aluminium, but all other suitable metals may be used. Further, the manufacture advantage is involved that the cover and bottom plates can be connected to the outer cylinder by simple annular welds or brazing, or soldering, respectively, joints.

Further, it is advantageous that the connection plates at the cover and bottom plates can be equipped with standardized connections for refrigerant lines, the connections for the low-pressure refrigerant lines being located in the central axis of the component and the connections for the high-pressure refrigerant lines being located outside the container centre so that unique assignment results when assembling the refrigerant lines.

It is also advantageous when volume is provided for the warmed up low-pressure refrigerant mass flow by means of spacers that may be formed at the accumulator substantially horizontal with the bottom plate.

It is advantageous during manufacture when the suction tube of the accumulator is assembled of two parts, one part being established as a straight tube with the vapor exit and the other part being deformed such that vapor entrance at the upper end is arranged concentrically to the central line and a U-shaped bend is positioned at the lower part of the accumulator through a spacer or a clip system formed at the accumulator in the centre of the accumulator. Further it is advantageous when the oil suction hole in the U-shaped bend and the vapor entrance of the suction tube are provided with a filter.

According to another embodiment of the invention for multi-evaporator HVACs, the connection plate at the cover plate may be provided with several low-pressure entrances and high-pressure exits.

A particularly efficient embodiment of the invention results when the deflecting device in the accumulator is provided with means for collecting liquid refrigerant, the means being capable of leading the liquid refrigerant into the lower region of the accumulator. Preferably, the means for collecting the refrigerant are established as eaves in form of a rain-water gutter. The deflecting device can be designed hemispherically, conically or parabolicly, according to the concept of the invention characterized by that the vapor entrance of the suction tube is located below the deflecting device. This prevents the refrigerant from being entrained as drops into the vapor entrance during operation of the combined component, which would result in reduced separating and storing capacities of the accumulator.

BRIEF DESCRIPTION OF THE DRAWINGS

The above and other objects and advantages of the invention will become readily apparent to those skilled in the art from reading the following descriptions of several embodiments of the invention when considered in the light of the accompanying drawings in which.

DETAILED DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner.

Figure 1:
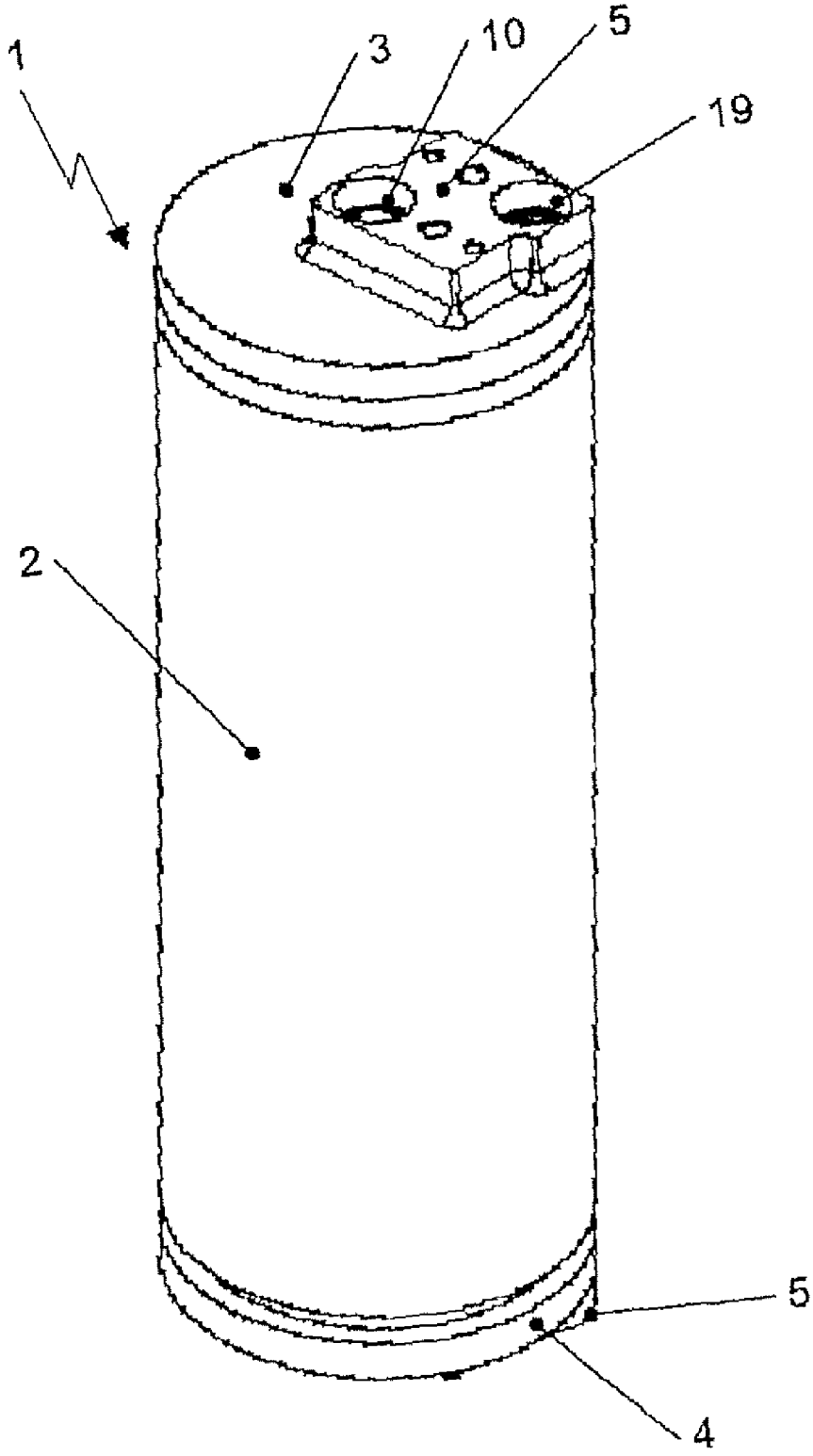
FIG. 1 is a perspective representation of an internal heat exchanger with an accumulator in accordance with an embodiment of the invention.

In FIG. 1, a perspective representation of an internal heat exchanger with accumulator 1 according to the invention is shown. Essentially, the structure includes a main body including a tubular outer cylinder 2 with a cover plate 3 and a bottom plate 4. The cover plate 3 and the bottom plate 4 are substantially identical components so that the external case of the internal heat exchanger 1 can be manufactured cost-efficiently from part of a cylindrical tube and the two standardized cover and bottom plates 3, 4.

The cover and bottom plates 3, 4 are provided with connection plates 5 to which refrigerant lines (not shown) of a refrigerant circuit (not shown) can be connected. Therefore, the connection plates 5 are provided with the corresponding refrigerant line connectors, which meet the sealing requirements to the exterior even for high-pressure refrigerants such as carbon dioxide, for example.

Figure 2:
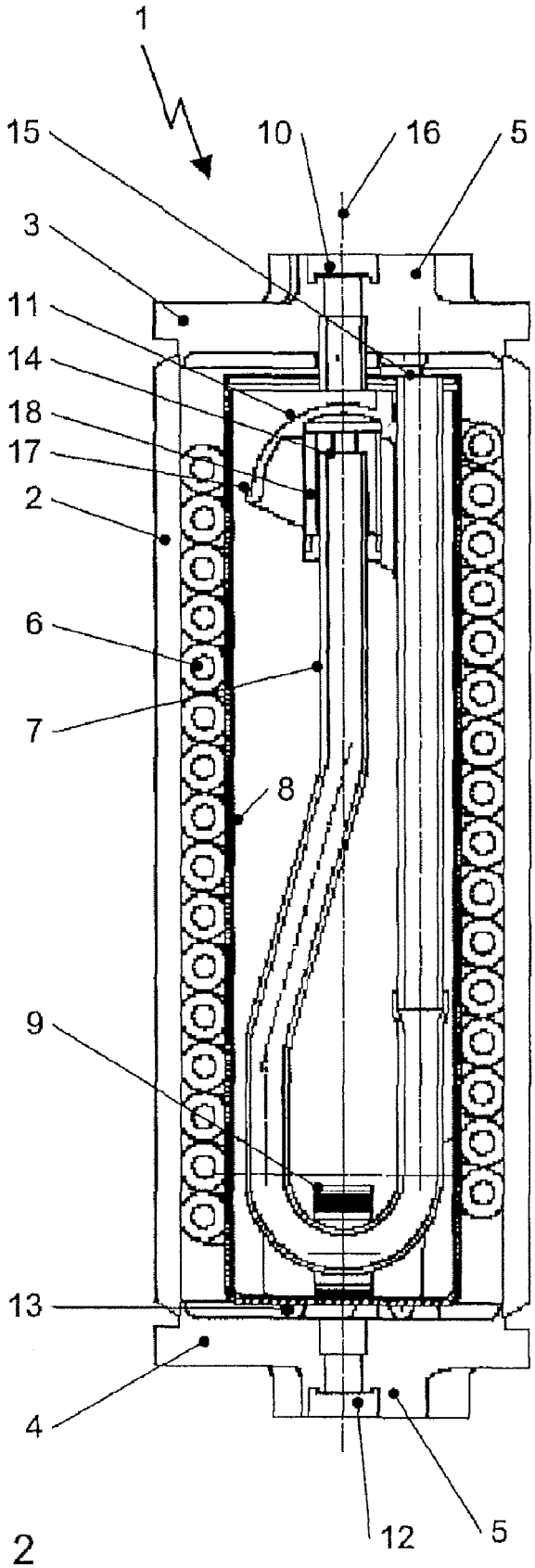
FIG. 2 is a longitudinal sectional view of the internal heat exchanger with an accumulator illustrated in FIG. 1 through the suction tube.

As more clearly shown in FIG. 2, in the center of the cover and bottom plates 3, 4, preferably the low-pressure gas connection, or a low-pressure entrance 10 and a low-pressure exit 12, respectively, are disposed. The accumulator 8 of the internal heat exchanger with accumulator 1 is shown in longitudinal sectional view. A finned tube 6, finned only in the region of the coils in the embodiment shown, is arranged in the form of a coil in the gap formed concentrically to a central axis 16 and the outer cylinder 2, the ends of the finned tube 6 being connected to the cover plate 3 and the bottom plate 4 by use of threaded joints (not shown), for example. In addition to the threaded joints, sealing elements in form of O-rings or positive connecting elements (not shown), for example, can be provided.

The accumulator 8 is established of a minimized heat-conductive, such as a light-weight plastic material, for example, so that the weight of the total component is clearly reduced. Further, the accumulator 8 at its lower edge is provided with spacers 13 which, in a vertical direction to the bottom plate 4, space apart the accumulator 8. In the volume formed thereby between the accumulator 8 and the bottom plate 4, the low-pressure gas flows after having passed through the spaces of the finned tube 6, to the low-pressure exit 12. In the interior of the accumulator 8, a suction tube 7 is provided as a two-part structure. The suction tube 7, with a vapor entrance 14 protected by a gas filter 18, is positioned below a deflecting device 11 in the accumulator 8 so that mixed liquid/vapor refrigerant entering through the low-pressure entrance 10 contacts the deflecting device 11. The liquid constituents of the low-pressure refrigerant flow over means for collecting the liquid refrigerant 17 at the deflecting device 11 along the suction tube 7 into the lower part of the accumulator 8. In the embodiment shown, the means for collecting the liquid refrigerant 17 are established as eaves in form of a rain-water gutter. The vapor refrigerant flows over the vapor entrance 14, which is arranged in a protected manner, of the suction tube 7 through a U-shaped region of the suction tube 7 to a vapor exit 15 thereof, which is located outside the accumulator 8. The refrigerant vapor then passes the gap between the accumulator 8 and the outer cylinder 2 and absorbs heat from the fins of the finned tube 6 of the high-pressure train, before it leaves the internal heat exchanger with accumulator 1 over the low-pressure exit 12, as mentioned above.

An oil filter 9 is disposed above an oil suction hole in the U-shaped region of the suction tube 7.

Figure 3:
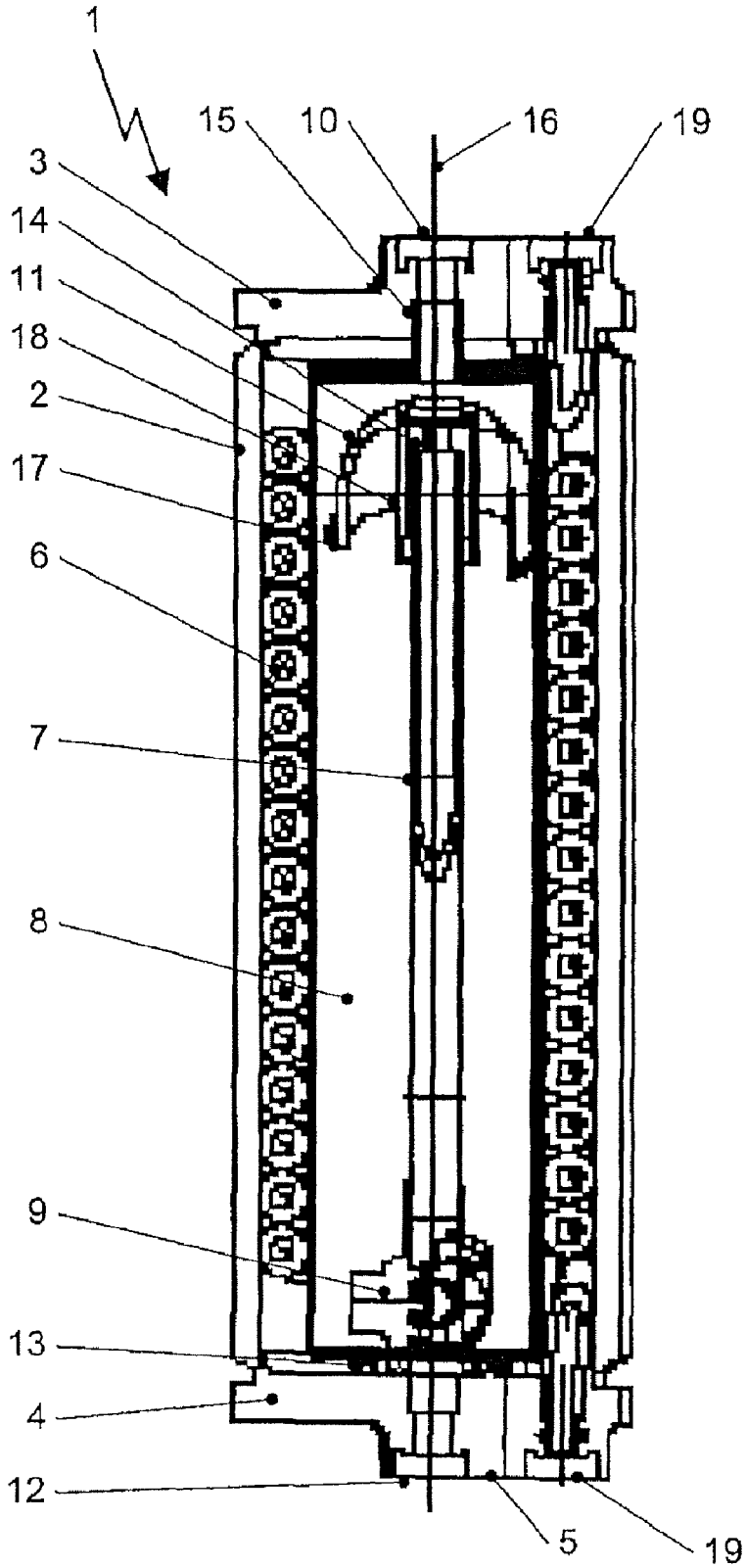
FIG. 3 is a longitudinal sectional view of the internal heat exchanger with an accumulator illustrated in FIG. 1 through the high-pressure entrance and exit.

In FIG. 3, a longitudinal sectional view of the internal heat exchanger with accumulator 1 through a high-pressure entrance and exit 19 is shown. The branches of the suction tube 7 are thus disposed after each other, while the high-pressure entrance and exit 19 of the internal heat exchanger are shown by the sectional view in the cover and bottom plates 3, 4. The connections of the tube ends of the finned tube 6 at the cover and bottom plates 3, 4 are disposed over the connection plates 5. The connection plates 5 of the cover plate 3 and the bottom plate 4 are provided with male or female connection elements for refrigerant lines.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A heat exchanger comprising:

a hollow main body having a cover plate and a bottom plate, wherein the cover plate and the bottom plate are substantially identical;

an accumulator substantially concentrically disposed in the main body for transmitting a liquid refrigerant at low pressure, wherein the accumulator includes a suction tube and a deflecting device for separating liquid and vapor phases of the refrigerant, the suction tube having a vapor entrance and a vapor exit, wherein the vapor entrance is disposed below the deflecting device and the vapor exit is located outside the accumulator in a gap formed between the accumulator and the main body; and a finned tube for transmitting the refrigerant at high pressure, wherein the finned tube is coiled around the accumulator and disposed in the gap formed between the accumulator and the main body, wherein the cover plate and the bottom plate are disposed at opposing ends of the main body and together with the main body enclose an entirety of the accumulator, and wherein a first end of the firmed tube is sealed to the cover plate and a second end of the finned tube is sealed to the bottom plate.

2. The heat exchanger according to claim 1, wherein the accumulator is formed from a material wherein heat conductance is minimized.

3. The heat exchanger according to claim 1, wherein the accumulator is formed from plastic.

4. The heat exchanger according to claim 1, wherein the cover plate and the bottom plate are provided with a connection plate, the connection plate including connections for refrigerant lines.

5. The heat exchanger according to claim 1, wherein the suction tube of the accumulator is U-shaped.

6. The heat exchanger according to claim 1, wherein the deflecting device includes a means for collecting the liquid refrigerant and a means for transmitting the refrigerant into the lower region of the accumulator.

7. The heat exchanger according to claim 1, wherein the suction tube includes a first portion and a second portion, wherein the first portion is a substantially straight tube and includes the vapor exit and the second portion is formed such that an upper end of the vapor entrance is disposed concentrically with a central axis of the heat exchanger and a bottom portion of a U-shaped bend formed in the second portion is disposed at a lower region of the accumulator.

8. The heat exchanger according to claim 7, wherein the U-shaped bend includes an oil suction hole and an oil filter and the vapor entrance of the suction tube includes a gas filter.

9. The heat exchanger according to claim 1, wherein the main body is formed from aluminum.

10. The heat exchanger according to claim 1, further comprising a plurality of spacers disposed between the accumulator and at least one of the cover plate and the bottom plate.

11. A heat exchanger comprising:

a hollow aluminum main body having a cover plate and a bottom plate;

an accumulator substantially concentrically disposed in the main body for transmitting a liquid refrigerant at low pressure, wherein the accumulator includes a suction tube and a deflecting device for separating liquid and vapor phases of the refrigerant, the suction tube having a vapor entrance and a vapor exit, wherein the vapor entrance is disposed below the deflecting device and the vapor exit is disposed outside the accumulator in a gap formed between the accumulator and the main body, and wherein the accumulator is formed from a material which minimizes heat conductance; and a coiled finned tube for transmitting the refrigerant at high pressure, wherein the finned tube is coiled around the accumulator and disposed only in the gap formed between the accumulator and the main body, wherein the cover plate and the bottom plate are disposed at opposing ends of the main body and together with the main body enclose an entirety of the accumulator, and wherein a first end of the finned tube is sealed to the cover plate and a second end of the finned tube is sealed to the bottom plate.

12. The heat exchanger according to claim 11, wherein the suction tube includes a first portion and a second portion, wherein the first portion is a substantially straight tube and includes the vapor exit and the second portion is formed such that an upper end of the vapor entrance is disposed concentrically with a central axis of the heat exchanger, a bottom portion of a U-shaped bend formed in the second portion is disposed at a lower region of the accumulator, and wherein the U-shaped bend includes an oil suction hole and an oil filter and the vapor entrance of the suction tube includes a gas filter.

13. The heat exchanger according to claim 11, wherein the deflecting device includes a means for collecting the liquid refrigerant and a means for transmitting the refrigerant into the lower region of the accumulator.

14. A heat exchanger comprising:

a main body including a tubular outer cylinder, a cover plate, and a bottom plate;

an accumulator substantially concentrically disposed in the main body for transmitting a liquid refrigerant at low pressure, wherein the accumulator includes a suction tube and a deflecting device for separating liquid and vapor phases of the refrigerant, the suction tube having a vapor entrance and a vapor exit, wherein the vapor entrance is disposed below the deflecting device and the vapor exit is disposed outside of the accumulator in a gap formed between the accumulator and the main body, wherein the suction tube includes a first portion and a second portion, the first portion including the vapor exit and the second portion including the vapor entrance and a U-shaped bend having an oil suction hole and an oil filter, and wherein the vapor entrance is disposed concentrically with a central longitudinal axis of the heat exchanger at an upper region of the accumulator and the U-shaped bend of the second portion is disposed at a lower region of the accumulator, the vapor entrance of the suction tube including a gas filter, the deflecting device including a means for collecting the liquid refrigerant and a means for transmitting the refrigerant into the lower region of the accumulator; and a finned tube for transmitting the refrigerant at high pressure, wherein the finned tube is coiled around the accumulator and disposed in a gap formed between the accumulator and the tubular outer cylinder, wherein the cover plate and the bottom plate are disposed at opposing ends of the tubular outer cylinder and together with the tubular outer cylinder enclose an entirety of the accumulator, and wherein a first end of the finned tube is sealed to the cover plate and a second end of the finned tube is sealed to the bottom plate.

* * * * *